US006322401B2

(12) United States Patent
Suzuki

(10) Patent No.: US 6,322,401 B2
(45) Date of Patent: Nov. 27, 2001

(54) ELECTRICAL CONNECTOR HAVING CONTACT ORIENTATION FEATURES

(75) Inventor: Mitsuru Suzuki, Kanagawa (JP)

(73) Assignee: Tyco Electronics. AMP, K.K., Kanagawa (JP)

( * ) Notice: Subject to any disclaimer, the term of this patent is extended or adjusted under 35 U.S.C. 154(b) by 0 days.

(21) Appl. No.: 09/734,090

(22) Filed: Dec. 11, 2000

(30) Foreign Application Priority Data

Dec. 13, 1999 (JP) ..... 11-353003

(51) Int. Cl.[7] ..... H01R 13/42
(52) U.S. Cl. ..... 439/751; 439/752.5
(58) Field of Search ..... 439/751, 354, 439/347, 188, 352, 353, 538, 578, 610, 585, 843, 851, 839, 852, 862, 816, 856, 857, 858, 861, 752.5, 733.1, 685, 495, 496, 497, 498, 499

(56) References Cited

U.S. PATENT DOCUMENTS

Re. 31,142 * 2/1983 Simmons ..... 339/74
4,220,388 * 9/1980 Dechelette ..... 339/74
4,415,221 * 11/1983 Inoue et al. ..... 339/258
5,730,629 * 3/1998 Samejima et al. ..... 439/855
5,941,740 * 8/1999 Neuer et al. ..... 439/852

FOREIGN PATENT DOCUMENTS 248017 11/1968 (JP) .
S62-195984 12/1987 (JP) ..... H01R/13/42
S60-750 1/1985 (JP) ..... H01R/13/50

* cited by examiner

*Primary Examiner*—Gary Paumen
*Assistant Examiner*—P Nguyen

(57) ABSTRACT

The electrical connector of the present invention is equipped with contacts that are secured in a housing. The contacts are formed to have a pair of spring members surrounding a contact receiving opening. The housing has contact receiving cavities for accommodating each contact. Each contact receiving cavity is contoured to have a base wall, a mating contact receiving opening passing through the base wall and a rail projecting from the base wall, the rail extending along the base wall on opposite sides of the mating contact receiving opening. During contact insertion the spring members grip the rail to angularly orient the contact within the contact receiving cavity.

17 Claims, 4 Drawing Sheets

ELECTRICAL CONNECTOR HAVING CONTACT ORIENTATION FEATURES

FIELD OF THE INVENTION

The present invention relates to an electrical connector and more specifically to an electrical connector having housing and contact features for assuring the proper contact position in the housing.

BACKGROUND

Contacts fixed in a housing and having expandable contact receiving openings for receiving mating contacts are generally known. One such example is shown in Japanese Design Registration No. 248017

The housing described in Japanese Design Registration No. 248017 has contact receiving openings and contact receiving cavities; however, when the contacts are accommodated in the contact receiving cavities, the contacts are guided only by the side walls of the cavities. The interiors of the contact receiving cavities of this housing must be formed so that they are slightly larger than the size of the contact sections in order to allow the expansion of the diameter of the contact sections.

A problem arises in that the contacts inserted into the contact receiving openings of the housing may rotate during insertion, so that the angular position of the contacts varies. As a result, it is difficult to guide the contacts into the interiors of the contact receiving cavities in a specifically desired angular orientation. If these contacts are not properly positioned in the housing they will not be aligned with complementary contacts of a mating connector and will result in poor or failed electrical connections.

Japanese Utility Model Application No. S62-195984 shows an electrical connector having contact guiding features wherein each of the contacts has a contact section that contacts a mating contact, and a wire termination section that is equipped with a pair of stabilizers. The housing has contact receiving openings, and a pair of grooves formed in each of these contact receiving openings. When the contacts are inserted into this housing, the contacts are guided into the contact receiving cavities by engagement of the pair of stabilizers with grooves formed in the contact receiving openings of the housing. However, since the pair of stabilizers are disposed on the termination section at the rear end of each contact it is possible to insert these contacts up side down.

The electrical connector described in Japanese Patent Application No. S60-750 also provides contact guiding features. This publication teaches a contact having a contact section consisting of a pair of arms that engage the mating contact. Furthermore, the housing has contact receiving openings and contact receiving cavities with ribs formed on the innermost sides of the contact receiving cavities. During the insertion of the contacts into this housing, the contacts are guided into the contact receiving cavities as a result of the ribs of the housing being engaged between the pair arms of the contact section. However, since the ribs of the housing are formed on the innermost side of the housing, upside down insertion of the contacts may not be prevented.

In light of the above facts, an object of the present invention is to provide an electrical connector which can prevent upside down insertion of the contacts in the initial stage of contact insertion, and which has a housing that guides the insertion of the contacts.

SUMMARY

The electrical connector of the present invention addresses these issues and is equipped with contacts that are secured in a housing. The contacts are formed to have a pair of spring members surrounding a contact receiving opening. The housing has contact receiving cavities for accommodating each contact. Each contact receiving cavity is contoured to have a base wall, a mating contact receiving opening passing through the base wall and a rail projecting from the base wall, the rail extending along the base wall on opposite sides of the mating contact receiving opening. During contact insertion the spring members grip the rail to angularly orient the contact within the contact receiving cavity.

BRIEF DESCRIPTION OF THE DRAWINGS

The invention will now be described by way of example with reference tot he accompanying figures of which.

DETAILED DESCRIPTION OF THE PREFERRED EMBODIMENTS

The electrical connector of the present invention consists of contacts 100 and a housing 200. Each of these major components will now be described in greater detail.

Figure 5:
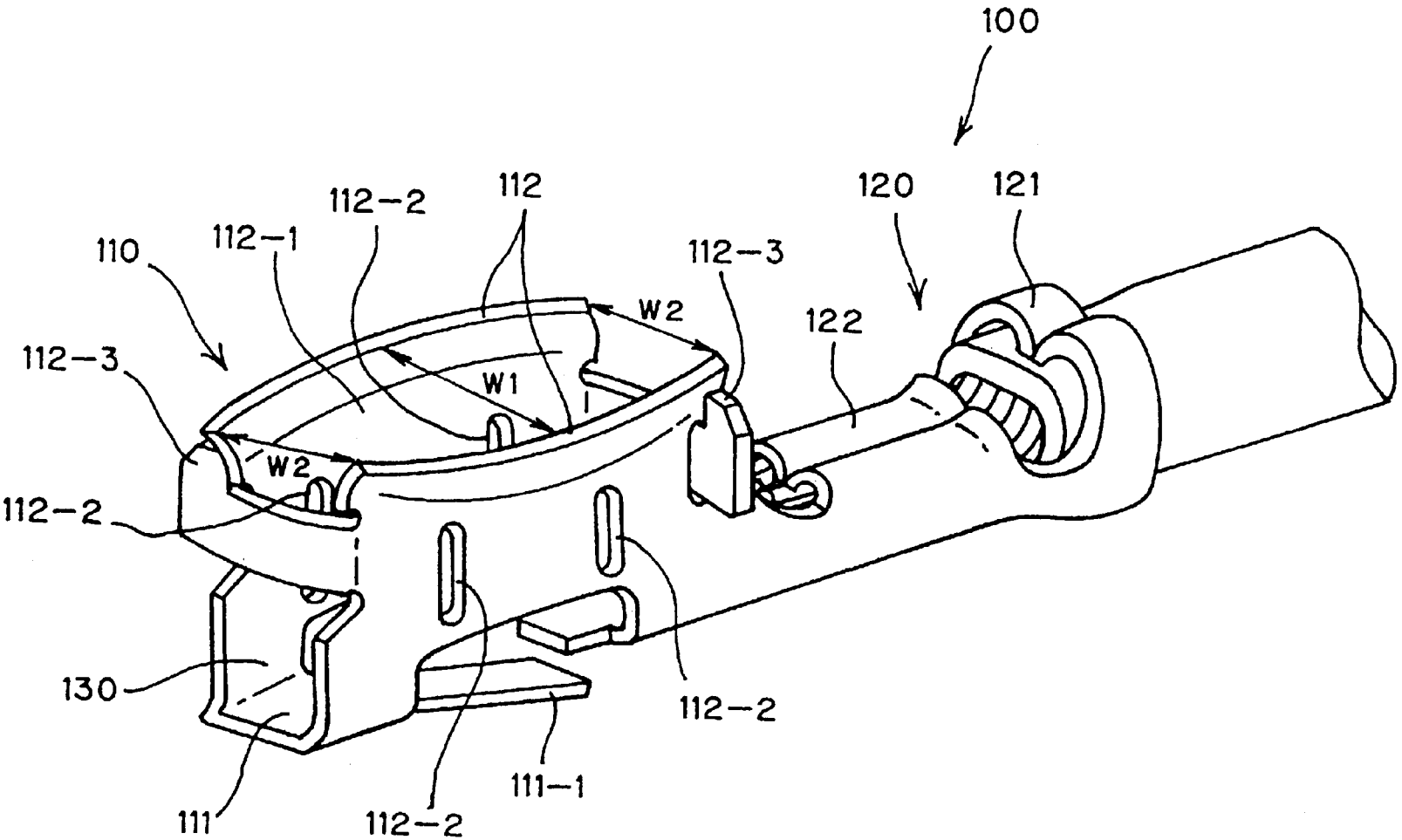
FIG. 5 is a perspective view of one of the contacts of one working configuration of the present invention.
Figure 6:
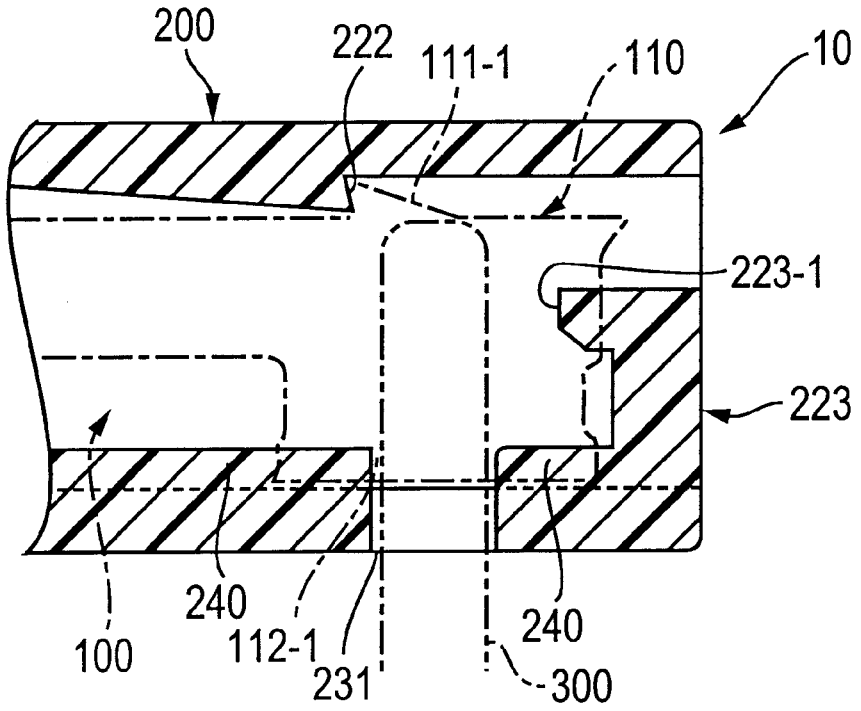
FIG. 6 shows one of the contacts and the corresponding mating contact in model form in a portion of the same sectional view of the housing as that shown in FIG. 3.

FIG. 5 is a perspective view of one of the contacts 100 of the present invention. This contact 100 has a contact section 110 on its front end, and a termination section 120 on its rear end. The contact 100 is formed by stamping and forming conductive sheet material. The contact section 110 consists of a base 111 and a pair of spring members 112 that extend vertically from both ends of the base 111. A lance 111-1 is disposed on the base 111. The respective ends of the pair of spring members 112 form a contact receiving opening 112-1 for receiving a pin type mating contact 300 (FIG. 6). The shape of the of the pair of spring members 112 is substantially arcuate such that the opening width W1 of the central portion is greater than the opening width W2 of both end portions. As shown in FIG. 6, when a mating contact 300 is inserted into the contact receiving opening 112-1, the pair of spring members 112 spread outward, and elastically grip the mating contact 300 to form a reliable electrical connection. Furthermore, each of the pair of spring members 112 has slits 112-2 that extend along a mating direction. These slits 112-2 are used to increase the flexibility of the spring members 112. An arm 112-3 is formed on each of the spring members 112 and extends to the other spring member. The arm 112-3 are secured to the opposite spring member 112 to prevent the spring member 112 from spreading further than desired. An opening 130 is formed by the base 111 and the pair of spring members 112 at the end of the contact.

The termination section 120 has an insulation barrel 121 which presses against the insulation of an electrical wire, and a wire barrel 122 which electrically connects the conductive wire. The insulation barrel 121 and wire barrel 122 are crimped around the wire in a conventional manner.

The housing 200 will now be described in greater detail with reference to FIGS. 1 through 4. The housing 200 is formed of an insulating material, preferably molded from a resin. Contact receiving openings 210 are provided in the mating end and contact receiving cavities 220 extend inward from the contact receiving openings 210. Although the electrical connector 10 is shown in these drawings as having three contacts 100 and three respective contact receiving cavities 220 other numbers of contacts 100 and cavities 220 are anticipated by the invention.

Mating contact receiving openings 231 are formed in a base wall 230. The contact receiving openings 112-1 are positioned in the housing 200 to face the mating contact receiving openings 231. The center of each contact receiving opening 112-1 is positioned to coincide with the center of its respective mating contact receiving opening 231 in the housing 200. The three mating contact receiving openings 231 are preferably arranged on the base wall 230 in the form of an equilateral triangle.

The housing 200 has three rails 240 that extend from the contact receiving openings 210 in to the contact receiving cavities 220. These rails 240 protrude toward the contact receiving cavities 220 from the inside the base wall 230. The width W of these rails 240 (FIG. 4) is preferably approximately the same as the smallest opening width W2 of the contact receiving openings 112-1. Accordingly, the rails 240 are clamped by the pair spring members 112 so that the contacts 100 are guided toward the contact receiving cavities 220. In order to facilitate clamping by the pair of spring members 112, the leading edge 241 of each rail is tapered so that the rail gradually becomes thinner toward the contact receiving opening 210. As a result, the contacts 100 are inserted into the housing 200 with a stable angular orientation and are centered in the direction of width.

Since the pair of spring members 112 of each contact 100 are disposed on the front end of the contact as was described above, insertion of the contact in an incorrect angular orientation (ie, upside down)is prevented. Incorrect insertion is prevented by the leading edge 241 of the rail in the contact receiving opening 210. An incorrectly inserted contact is prevented from entering the cavity 220 at an early stage of contact insertion.

Figure 1:
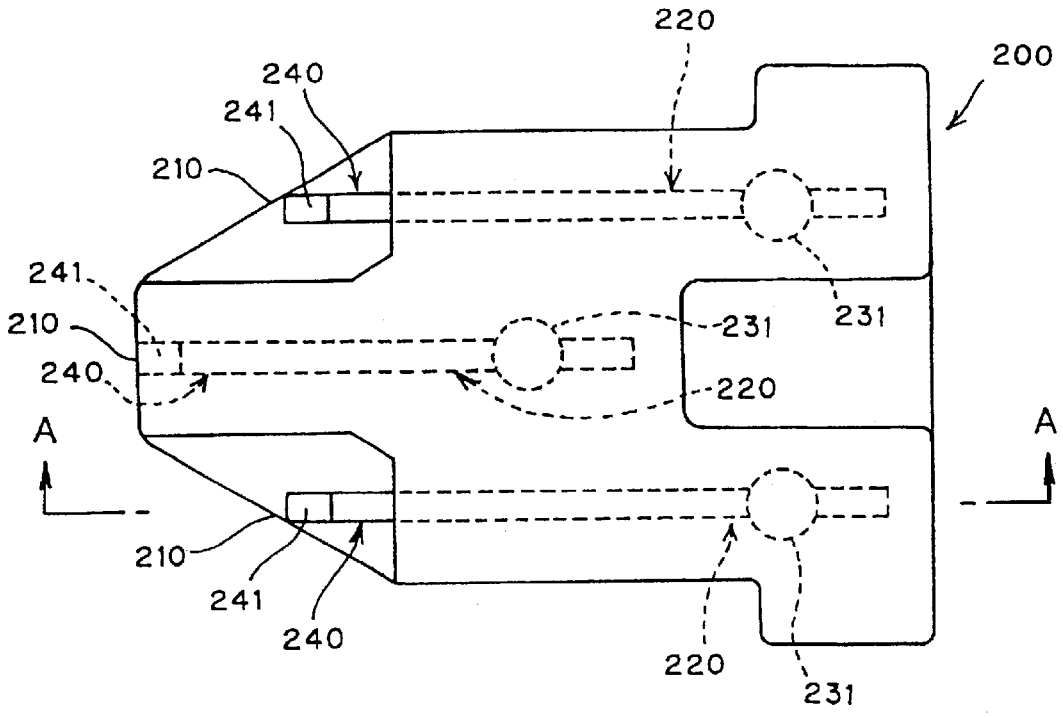
FIG. 1 is a plan view of a housing according to the present invention.
Figure 2:
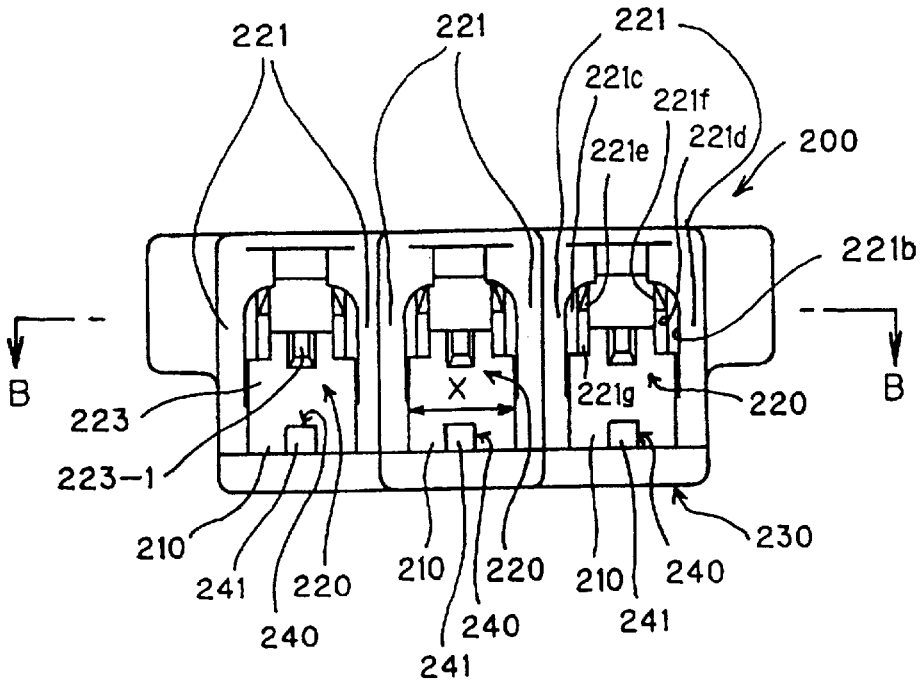
FIG. 2 is a left-side view of the housing shown in FIG. 1.
Figure 3:
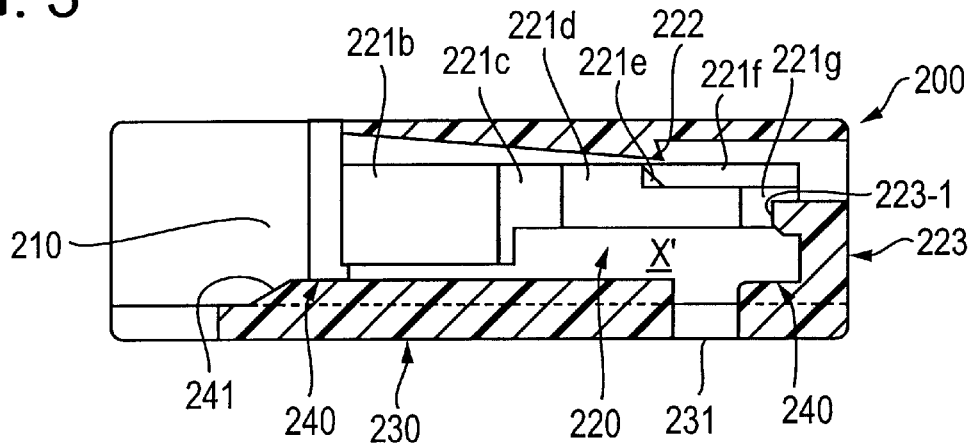
FIG. 3 is a sectional view of the housing along line A—A in FIG. 1.
Figure 4:
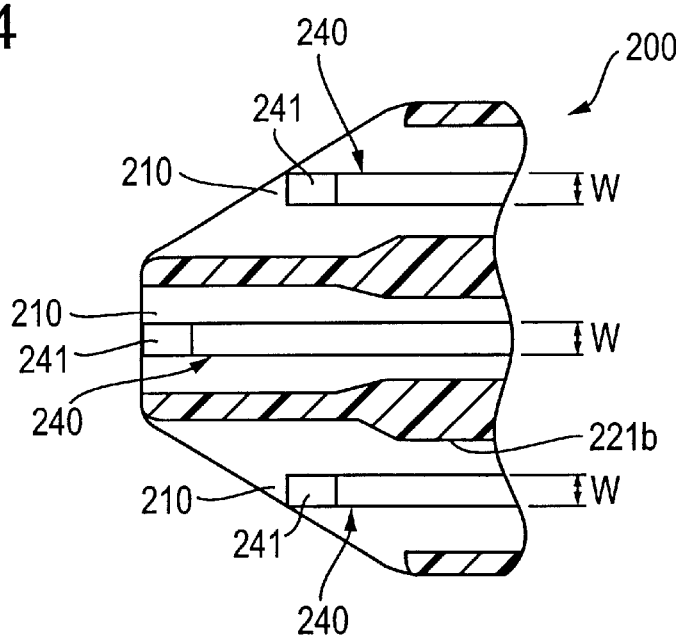
FIG. 4 shows a portion of the contact receiving opening side in a sectional view of the housing along line B—B in FIG. 2.

The side walls 221 of each contact receiving cavity 220 have symmetry and are formed by three tapered surfaces 221*c*, 221*e* and 221*g* and three flat surfaces 221*b*, 221*d* and 221*f* (see FIGS. 2 through 4). Each cavity is shaped to conform to the side-surface shape of the contact 100. A sufficient width X, X' is provided in the cavity 220 to allow the spring members 112 to expand during mating.

As shown in FIG. 3, the rails 240 extend from the contact receiving openings 210, past, to the rear walls 223. While the rails 240 extend past the mating contact receiving openings 231, they do not cover the mating contact receiving openings 231 to allow mating contact insertion. It should be understood that the rails 240 do not necessarily have to extend tot he rear walls 223. Depending upon the requirements of the design, the rails 240 may be of an alternate length. Since the width W of the rails (see FIG. 4) is approximately the same as the smallest opening width of the contact receiving opening 112-1, the contact section 110 can elastically contact the mating contact 300 as shown see the two-dot chain line in FIG. 6. While the contact 300 is mated, the spring members 112 may release the rails 240.

Referring again to FIG. 3, an anchoring projection 222 that engages with the lance 111-1 of each contact is disposed in each contact receiving cavity 220, and a protrusion 223-1 is formed on the rear wall 223.

Assembly and mating of the electrical connector 10 formed by the contacts 100 and housing 200 will be described with reference to FIG. 6. FIG. 6 shows one of the contacts 100 and the corresponding mating contact 300 in a sectional view. Here the contact section 110 and mating contact are shown in phantom. The contact 100 is inserted inside the housing 200 such that the contact receiving opening 112-1 faces downward and is aligned with the mating contact receiving opening 231 of the housing 200. The rear wall 223 serves to properly position the contact 100 in the contact receiving cavity 220 while the interaction of rails 240 with spring members 112 serve to assure proper angular orientation of the contact 100. Once the contacts 100 are fully inserted in the proper position and angular orientation, the lances 111-1 engage with the anchoring projections 222, so that the contacts are secured within the contact receiving openings 210.

Advantageously, the present invention provides an electrical connector which prevents upside down or incorrect insertion of the contacts in the initial stage of contact insertion, and which guides subsequent contact insertion.

What is claimed is:

1. An electrical connector comprising:

a plurality of contacts, each contact having a pair of spring members surrounding a contact receiving opening; and, a housing having contact receiving cavities, each cavity having a base wall, a mating contact receiving opening in the base wall and a rail projecting from the base wall, the rail extending along the base wall on opposite sides of the mating contact receiving opening, whereby the spring members grip the rail to angularly orient the contact within the contact receiving cavity.

2. The electrical connector of claim 1 wherein each contact further comprises an arm connecting the spring members.

3. The electrical connector of claim 1 wherein each contact further comprises a termination section located at a rear end.

4. The electrical connector of claim 1 wherein each contact further comprises a wire barrel and an insulation barrel in the termination section.

5. The electrical connector of claim 1 wherein each contact further comprises slits formed in each spring member.

6. The electrical connector of claim 1 wherein the spring members have an arcuate shape.

7. The electrical connector of claim 1 wherein each contact receiving cavity of the housing further comprises a rear wall for engaging an end of the respective contact.

8. The electrical connector of claim 1 wherein each rail extends from the rear wall along the base wall toward a contact receiving opening.

9. The electrical connector of claim 1 wherein each contact further comprises a lance extending from a base.

10. The electrical connector of claim 9 wherein each contact receiving cavity of the housing further comprises an anchoring projection for engaging the lance.

11. An electrical connector having contact guiding features including a guide rail disposed in a contact receiving cavity and a contact having a contact section for engaging the rail, the connector characterized in that the guide rail extends from a contact receiving opening to a rear wall of the contact receiving cavity and the contact section of the contact has spring members connected by arms for engaging the rail beginning at the contact receiving opening and continuing in engagement until fully inserted.

12. The electrical connector of claim 11 wherein each contact is further characterized by a termination section located a rear end.

13. The electrical connector of claim 11 wherein each contact is further characterized by a wire barrel and an insulation barrel in the termination section.

14. The electrical connector of claim 11 wherein each contact is further characterized by slits formed in each spring member.

15. The electrical connector of claim 11 wherein the spring members have an arcuate shape.

16. The electrical connector of claim 11 wherein each contact is further characterized by a lance extending from a base.

17. The electrical connector of claim 16 wherein each contact receiving cavity of the housing is further characterized by an anchoring projection for engaging the lance.

* * * * *